United States Patent [19]

Molina

[11] 4,348,175

[45] Sep. 7, 1982

[54] KILN CAR

[75] Inventor: Joao F. G. Molina, Jundiai, Brazil

[73] Assignee: American Standard Inc., New York, N.Y.

[21] Appl. No.: 207,504

[22] Filed: Nov. 17, 1980

[51] Int. Cl.[3] ..... F27D 1/12; F27B 9/26

[52] U.S. Cl. ..... 432/241; 432/137

[58] Field of Search ..... 432/241, 137

[56] References Cited

U.S. PATENT DOCUMENTS

| | | | |
|---|---|---|---|
| 1,587,210 | 6/1926 | Beecher et al. | 432/241 |
| 3,759,661 | 9/1973 | Barsby | 432/241 |
| 4,243,385 | 1/1981 | Jeffries, Jr. | 432/241 |

*Primary Examiner*—John J. Camby

*Attorney, Agent, or Firm*—James J. Salerno, Jr.; Robert G. Crooks; John P. Sinnott

[57] ABSTRACT

A kiln car which permits a substantial increase of product throughput per car per day through a kiln is disclosed. The kiln car includes a carriage for conducting the car through the kiln and a superstructure made of reduced mass of dense refractory components. A lower load-bearing base is arranged and constructed so that the load-bearing surface lies in a plane below the plane of the bench of the kiln to provide an increased cross sectional area for product firing. The low-mass, load-bearing base includes a plurality of spaced, dense, refractory blocks which are resistant to thermal shock, and capable of withstanding temperatures of about 1300° C., and are positioned around the perimeter of the carriage, with each block having a bore or socket for mounting a refractory column therein. A plurality of elongated dense refractory members or spacers are positioned around the perimeter, and are mounted between the refractory blocks to lock the blocks in place. Similar refractory blocks, centrally mounted, are aligned with the perimeter-positioned refractory blocks, and each includes a bore or socket. Dense, refractory plates for supporting product to be fired are disposed in spaced relation interiorly of the perimeter refractory blocks in adjustable fixed position on the base. A low-density, low heat capacity refractory material is interspersed in the spaces between the refractory blocks and refractory plates forming the low-mass, load-bearing base. An upper load-bearing base of dense refractory may be mounted on the refractory columns.

8 Claims, 6 Drawing Figures

KILN CAR

RELATED APPLICATION

Co-pending Application of Russell K. Wood Ser. No. 207,569 filed Nov. 17, 1980 for "Kiln Car".

BACKGROUND OF THE INVENTION

1. Field of the Invention

The present invention is directed to an improved kiln car for transporting an increased throughput of product through a kiln and, more particularly, to a kiln car having a refractory superstructure of reduced mass and improved thermal barrier means of low heat capacity to prevent heat damage to the carriage of the kiln car, and to permit more efficient use of energy in the kiln, while increasing the product throughput per car per day.

2. Review of the Prior Art

Kiln cars presently employed and/or described in the prior art use a steel carriage adapted to be mounted on a track for rolling the kiln car through a high temperature kiln; for example, a tunnel kiln. Mounted on the carriage are refractory materials sufficiently large and of a high mass, forming a solid base to support the setting refractories or product to be fired, to provide a thermal barrier for the steel carriage, so that the bearings and other moving parts are not affected by the heat. To improve the thermal barrier means, the spaces between the steel "I" beams of the carriage are filled with various insulating materials, such as described in U.S. Pat. No. 1,306,160. In U.S. Pat. No. 1,333,381, a specially designed kiln car is described having a superstructure in which the heated atmosphere circulating in the kiln is brought into direct contact with the product to be fired but also protects the product from the direct impact of the heat being introduced into the kiln. In U.S. Pat. No. 1,587,210, a kiln car for use in a tunnel kiln is described in which the car superstructure includes a specially designed imperforate layer made of a ceramic-bonded silicon carbide or crystalline alumina on which ware to be fired can be placed without the use of saggers. In U.S. Pat. No. 1,694,749, a kiln car is described in which the superstructure is arranged with shelves or trays which may be adjusted to varying heights to suit articles of various heights. In U.S. Pat. No. 1,777,856, a kiln car is described in which a layer of refractory bricks are placed on the steel carriage to provide an insulating barrier. In U.S. Pat. No. 2,879,577, an improved superstructure having horizontally-spaced shelves, supported by pillars, is described. In U.S. Pat. No. 3,377,670, an improved car top tile for kiln trucks is described. In U.S. Pat. No. 3,759,661, a low thermal mass kiln car is described in which nonload-bearing, thermal-insulating material forms part of the refractory superstructure. A plurality of posts for carrying an upper deck to support ware to be fired are mounted on the carriage of the kiln car and project upwardly through the thermal barrier. The posts are supported with lateral stability by sockets formed in the base. In U.S. Pat. No. 3,997,289, a kiln car is described having a refractory superstructure formed of a number of tiers one above the other, each being supported by refractory batts. From the foregoing, the concerns of the prior art included providing kiln car superstructures with sufficient refractory mass to prevent damage to the carriage. Also various attempts to reduce the mass of refractory by using thermal-insulating materials have been made. However, the problem of providing a refractory superstructure having sufficiently reduced heat conductivity to the steel carriage structure remains. Also, present refractory superstructures do not provide for an increase in throughput of product per car per day through a kiln with a resulting reduction of energy per piece fired.

SUMMARY OF THE INVENTION

It is therefore an object of the present invention to provide a kiln car which permits an increase of throughput of product per car per day through a high temperature kiln, while substantially reducing the amount of energy for firing each piece of product.

Another object of the invention is to provide an improved kiln car of low mass, so that the ratio of the weight of the car compared to the weight of the product processed is reduced approximately by half.

Another object of the invention is to provide a low-mass superstructure for a kiln car in which the load-bearing base is arranged and constructed of dense, refractory components of reduced mass so that the load-bearing surface of the base lies in a plane below the plane of the bench of the kiln to provide an increased cross-sectional area for product firing.

Another object of the invention is to provide a kiln car having a superstructure of reduced refractory mass, an increased throughput load capacity per car per day, which can be moved through the kiln at an increased speed, so that additional kiln cars can be utilized in a 24-hour period, thereby increasing the throughput of product, resulting in improved kiln efficiency.

Another object of the invention is to reduce product spoilage by providing a kiln car superstructure in which excessive weight of refractory to be heated and cooled is eliminated, which permits closer control of the rate of heating of the product in the pre-heat section of the kiln and controlled cooling of the product.

Another object of the invention is to provide a low maintainance kiln car, having a superstructure of reduced thermal conductivity, which prevents excessive heat transfer from the refractory components to the wheels, bearings and other moving parts of the carriage of the kiln car.

Another object of the invention is to provide a kiln car which will increase the capacity of product fired in a kiln per day, which reduces fuel requirements per pound of product fired by reducing the weight of the refractory forming the superstructure of the kiln car, thereby reducing the cost of product firing and increasing the efficiency of kiln operation.

From the foregoing objectives, the invention generally contemplates providing a kiln car which will substantially increase throughput of product per car per day through a high temperature kiln. The kiln car includes a steel carriage assembly havin wheels cooperating with a track for rolling the kiln car through a kiln, such as a tunnel kiln. Mounted on the upper steel surface of the carriage, is a layer of insulating refractory. An improved refractory superstructure of low mass having a lower load-bearing base, is mounted on the insulating refractory and includes a plurality of spaced, dense, refractory blocks which are resistant to thermal shock, and capable of withstanding temperatures of about 1300° C., and are positioned around the perimeter of the carriage, with each having a bore or socket for mounting a column of dense refractory therein. A plurality of elongated refractory members are positioned around the perimeter and mounted between the refractory blocks to lock the blocks in fixed position. Similar dense, refractory blocks, centrally mounted, are aligned with the perimeter-positioned blocks and each include a bore or socket. Dense refractory plates for supporting product to be fired are disposed in spaced relation interiorly of the perimeter refractory blocks in adjustable fixed position on the base. A low density, low heat capacity, refractory material is interspersed in the spaces between the refractory blocks and the refractory plate, thereby providing a low mass, load-bearing base of reduced heat conductivity. Additionally, an upper load-bearing base may be mounted on the refractory columns.

DESCRIPTION OF THE PREFERRED EMBODIMENT

Figure 1:
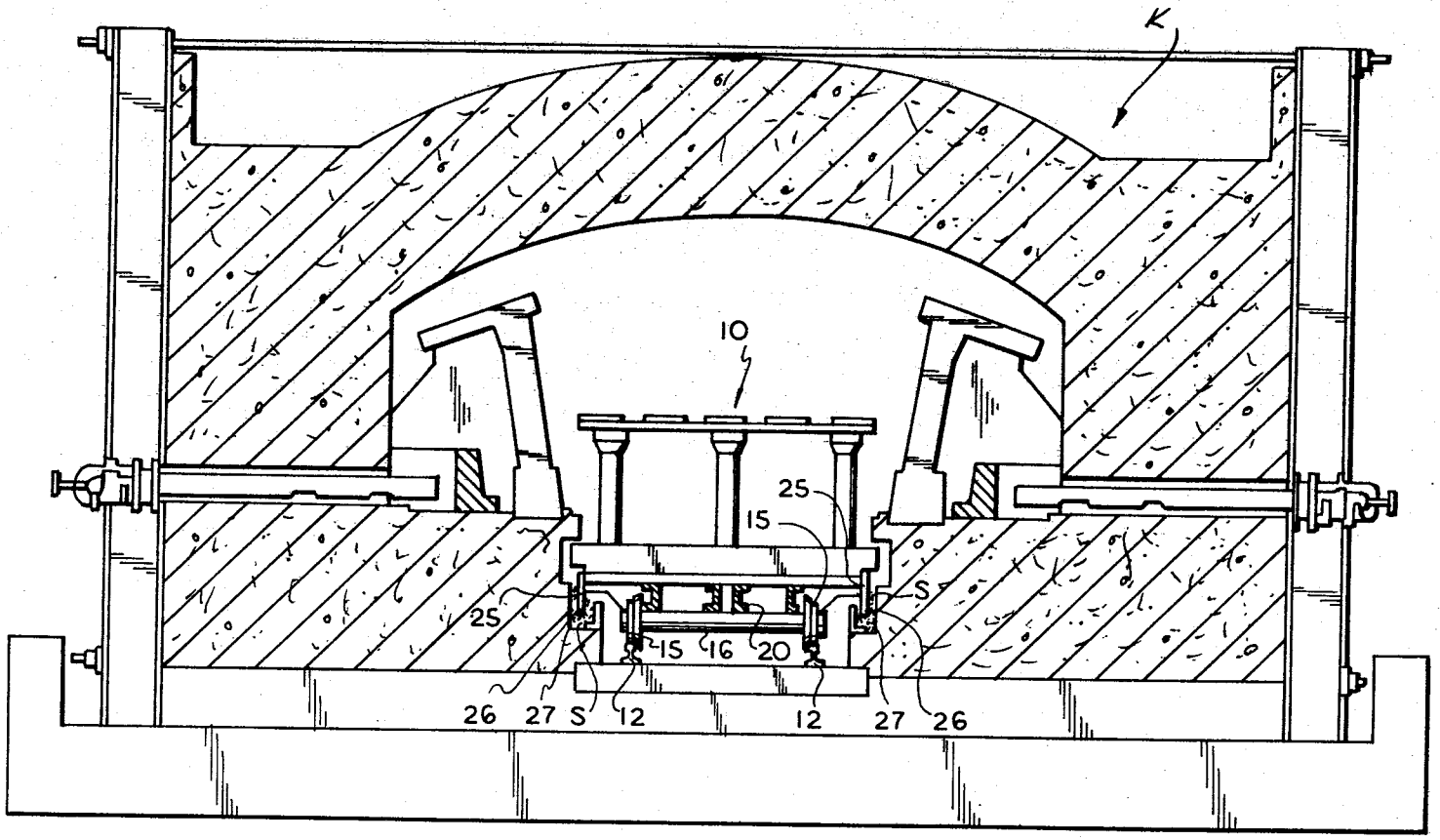
FIG. 1 is a sectional view in elevation, illustrating the kiln car passing through a tunnel kiln in which the lower load-bearing base lies in a plane below the plane of the bench of the kiln.

Kiln car 10, illustrated in FIG. 1, is depicted as it traverses through a high temperature kiln K of the tunnel type. Kiln car 10 is mounted for movement along track 12 by carriage assembly 14. Carriage assembly 14 includes front wheels 15 and axle 16, and rear wheels 17 and axle 18, which are coupled together by spaced steel beams 20. Transversely-spaced angle irons 23, positioned parallel to each other, provide rectangular-formed sections in which steel plates 22 are welded to form the upper surface for mounting the low-mass, low heat capacity, load-bearing base of dense refractory. Welded along each longitudinal side of carriage assembly 14, are depending side rails 25. Side rails 25 extend into a longitudinal slot 27 of tunnel K, which is filled with sand S to form a seal, so that the heat from the kiln will not pass between the walls of the kiln and kiln car 10. This prevents damage to the moving parts of the carriage assembly 14, such as the bearings and wheels.

Figure 2:
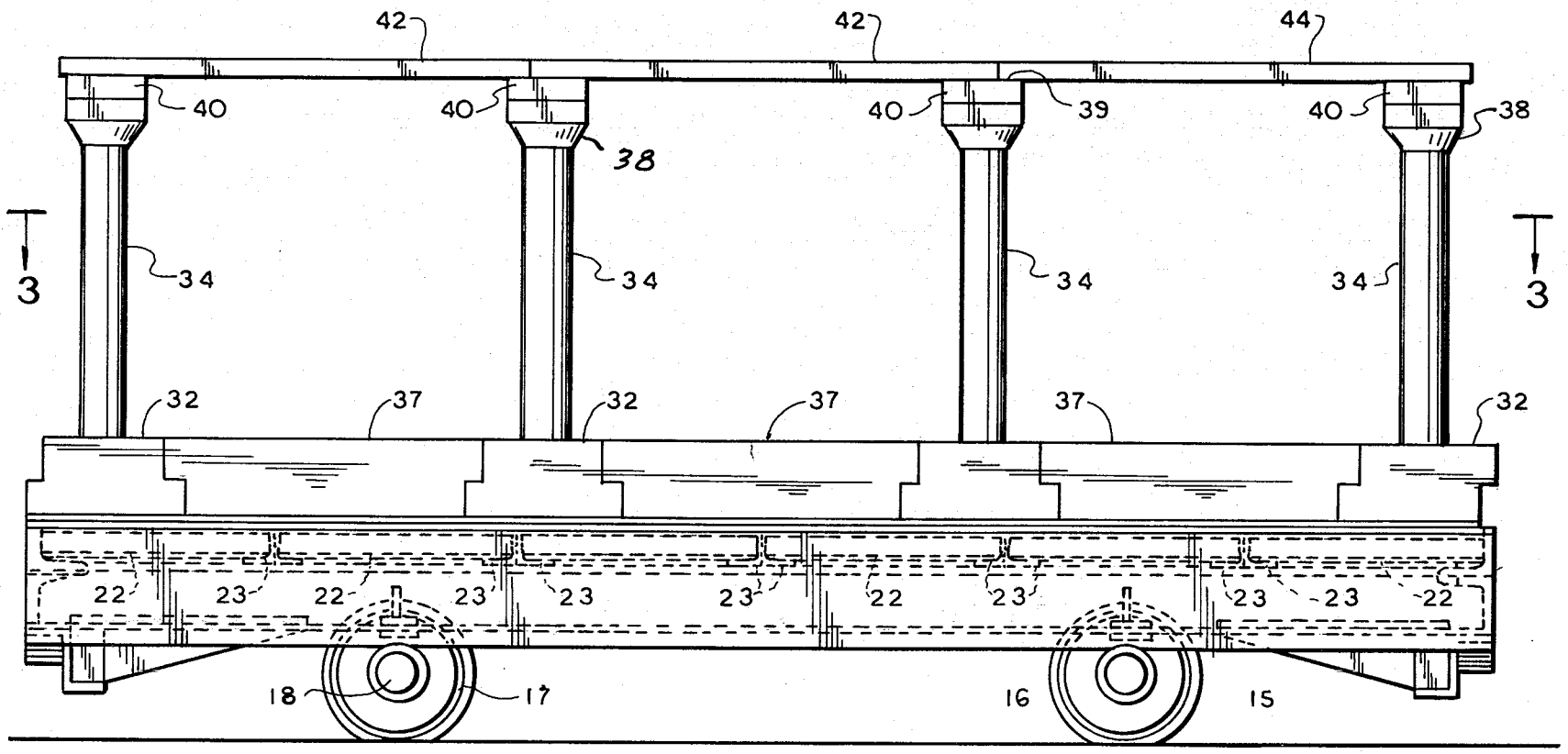
FIG. 2 is a side elevational view of the kiln car of the present invention.
Figure 3:
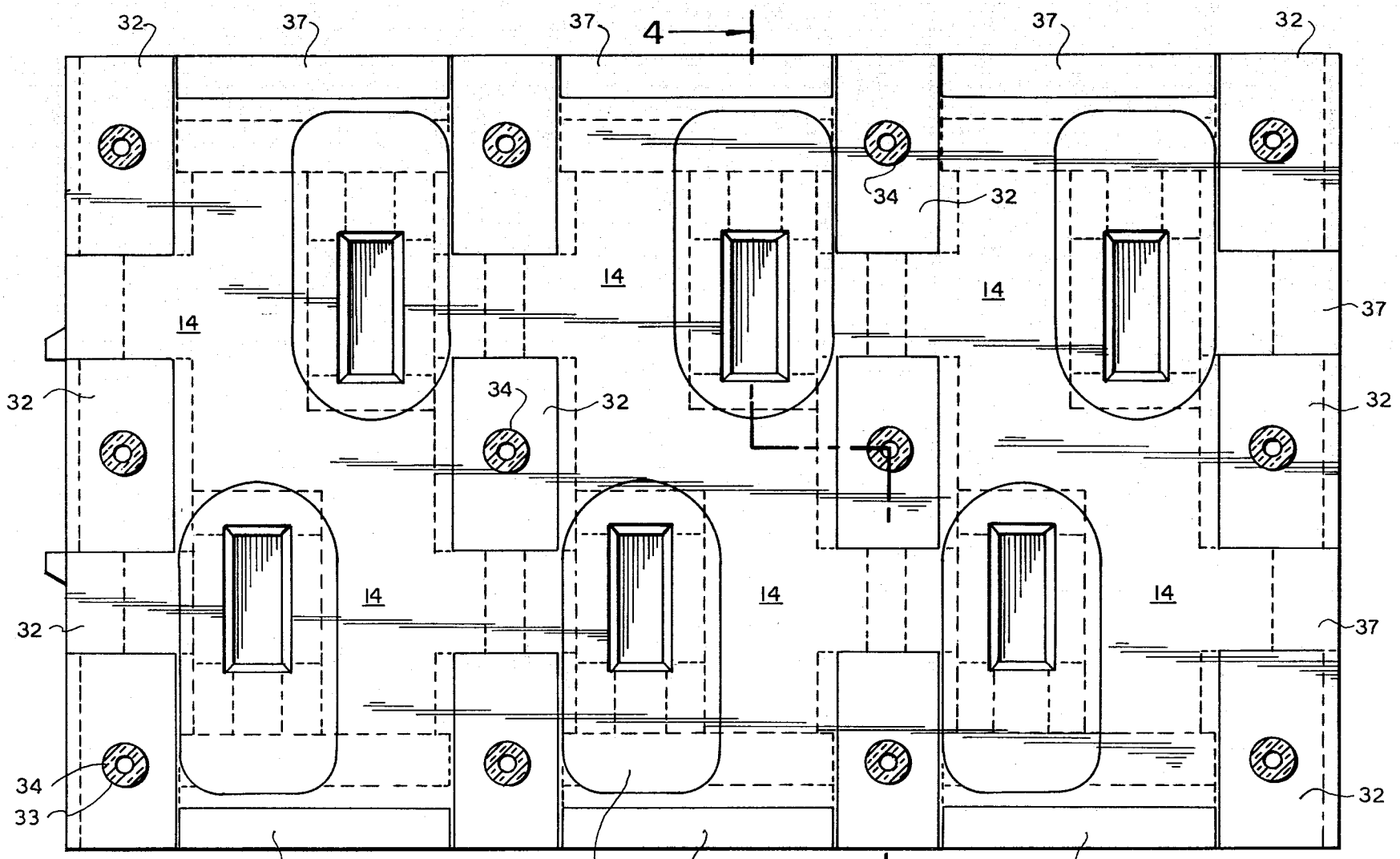
FIG. 3 is a top plan view taken along the line 3—3 of FIG. 2.
Figure 4:
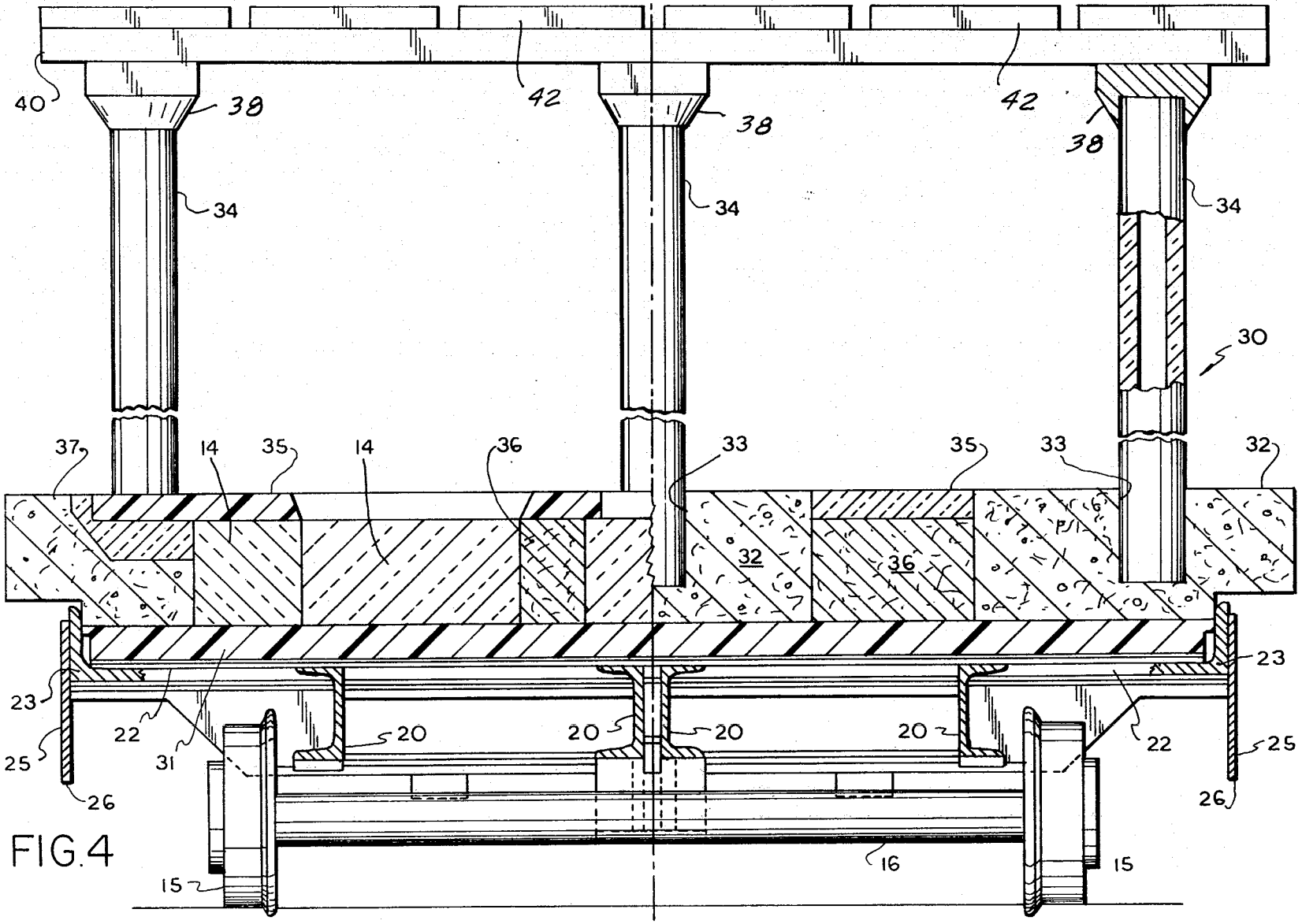
FIG. 4 is a side elevational view, partly in section, taken along the lines 4—4 of FIG. 3.

FIGS. 2 through 4 illustrate the various component parts which make up low-mass superstructure 30 of dense refractory. A layer of insulating refractory 31 is mounted on steel plates 22 to provide a thermal barrier between carriage assembly 14 and superstructure 30. As shown in FIG. 3, refractory blocks 32, each having a socket 33 for receiving a refractory column 34, are spaced in pattern-wise relation on insulating refractory 31. Each refractory blocks or spacers 37 are mounted between refractory blocks 32 to form a perimeter of dense refractory. Refractory blocks 32, positioned interiorly of the perimeter refractory blocks, are held in fixed position by refractory bricks 36. Each refractory block 32, 37 and refractory brick 36 are made of dense refractory, which is resistant to thermal shock and capable of withstanding temperatures of more than 1300° C. Refractory bricks 36 terminate a short distance from the top edge of blocks 32, so that dense refractory slab 35, such as a silicon carbide pallet, is positioned on top of refractory bricks 36 to form a platform on which product to be fired is placed. A low-density, low heat capacity, thermal-insulating material 14, for example: Fiber-Frax, an alumina fiber manufactured by the Carborundum Company; Kaowool, manufactured by Babcock and Wilcox; Inswool, manufactured by A. P. Green Refractories; and like materials, is disposed in the spaces interiorly of the perimeter refractory blocks to complete the low mass, load-bearing lower base.

Columns 34, which are made of a dense refractory such as silicon carbide mullite or the like, are tubular in cross section and mounted at one end in sockets 33 with dense refractory blocks 32, as illustrated in FIGS. 2 and 4. A cap 38 on column 34 is formed having an enlarged, flat, upper surface 39 on which silicon carbide, parallel rows of stringers 40 are mounted transversely. Longitudinally-spaced, parallel rows of stringers 42 are supported on stringers 40 to form a second or upper base or deck on which product to be fired is placed. As depicted in FIGS. 2–4, columns 34 are mounted in aligned rows and are spaced substantially equidistant and are parallel both longitudinally and transversely. Also, pallets 35 are shown in FIG. 3 as forming two parallel rows of pellets 35 which are offset with respect to each other. Obviously many patterns may be used to place the columns and pallets so as to obtain most efficient use of space for product firing.

In operation, the throughput of product through a tunnel kiln of the kiln car of the present invention was compared to the throughput of product through a typical, commercially-available kiln car of the stringer girder type. The commercially-available kiln car comprises a carriage assembly 7′2″ long and is of similar design to carriage assembly 14. The refractory superstructure is of a different design and has only a single load-bearing base for a load of product to pass through tunnel kiln K. The refractory superstructure is made up of car blocks, stringers and girders. Refractory car blocks, approximately 10″ high, are interlocked together and rest on the 7′2″ long, steel carriage assembly. On the car blocks, laterally spaced and positioned parallel to each other, are placed 10 refractory girders, 5 on each side, to form two rows. Each girder is made of kyanite, a dense refractory, and measures 26″×20″×9½″. Silicon carbide stringers are placed longitudinally on the girders and are spaced to accommodate the product to be fired. Each stringer measures 41″×5″×1½″. The overall height of the car is about 2′9½″ from the track to the top of the stringers. The total weight of the car blocks, girders, stringers and the product to be fired is 3,744 lbs. of refractories for a ratio of 4.89 lbs. of refractories to 1 lb. of china.

Figure 5A:
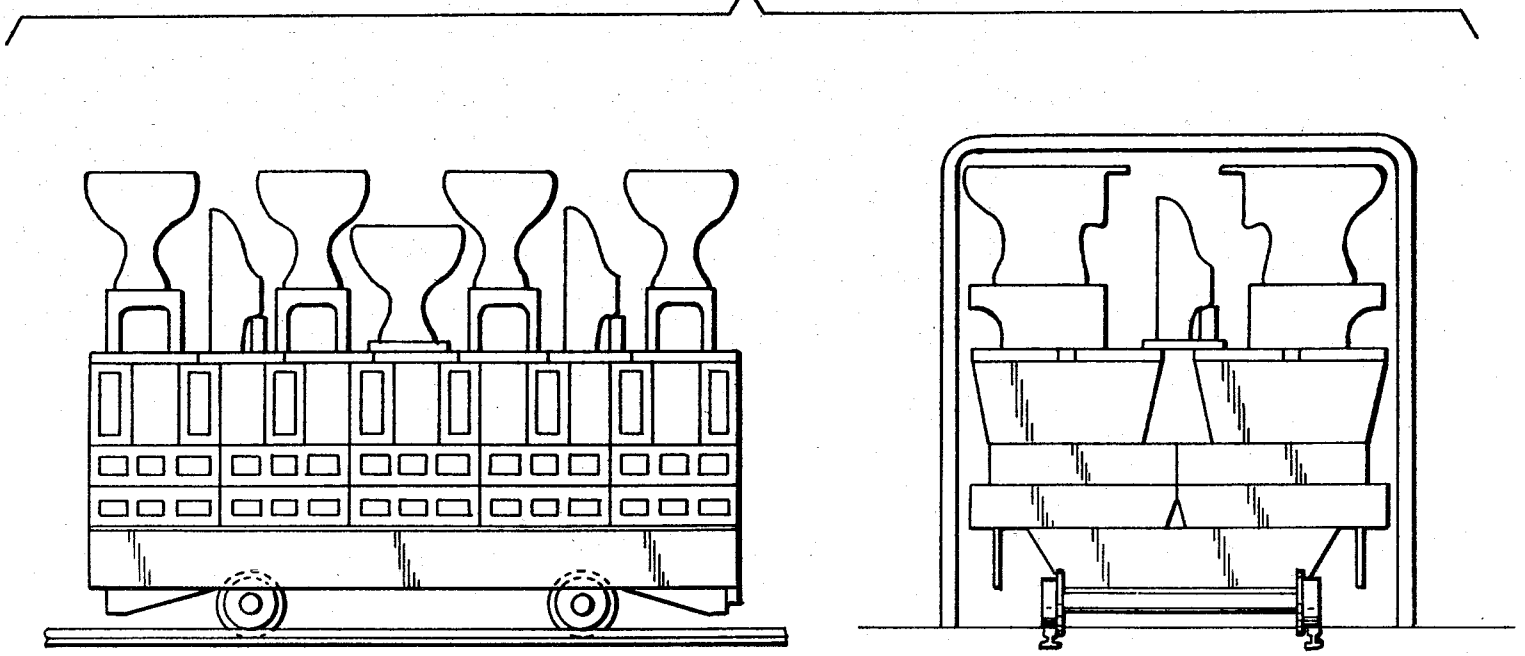
FIG. 5A PRIOR ART
FIGS. 5A and B are pictorial representations of the loading of a commercial kiln car as compared to the loading of the kiln car of the present invention in the same tunnel kiln.
Figure 5B:
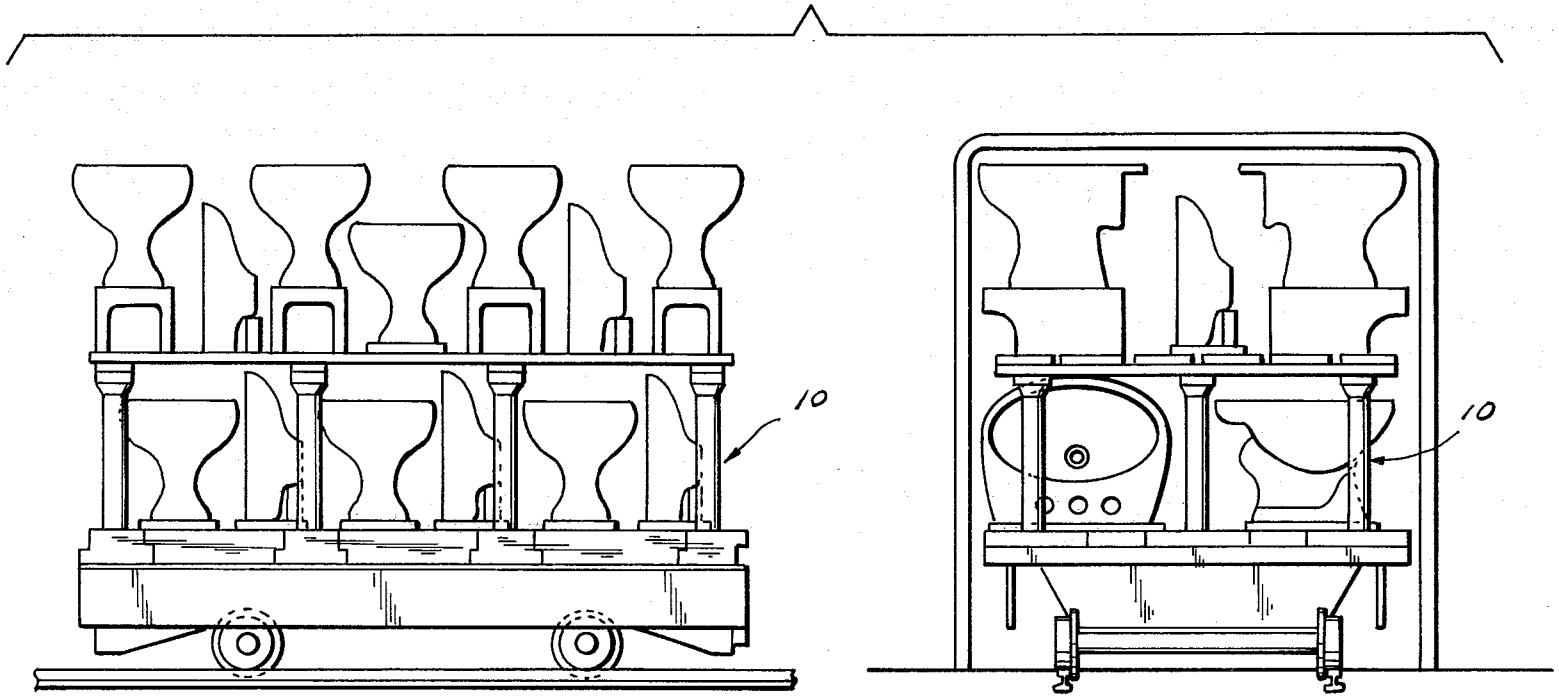

The kiln car of the present invention measures 86″ in length and 54.2″ in width. The large car blocks and girders of the stringer-girder car are replaced by smaller, dense, refractory blocks, refractory bricks and low-density, insulating material to substantially decrease the mass of the superstructure of the present invention. An insulating refractory, approximately 2″ thick, is placed on the top of carriage assembly 14. A perimeter of dense refractory blocks of a low-mass type are mounted in position on the insulating refractory. Two types of refractory blocks are used, each measuring 13.4″ in length 9.1″ in width and 5.5″ in height; one of the blocks 32 having a socket 33, measuring 22.6″ in length and 2.9″ in diameter, for mounting a silicon carbide column therein. The other type of refractory block 37 is a spacer block having latching means to interlock blocks 32 in a locked perimeter. Refractory blocks 32 are positioned on the insulating refractory interiorly of the perimeter and are aligned with the corresponding refractory block 32. The interior refractory blocks 32 are locked in place by refractory bricks 36, measuring 9.1" in length, 4.3" in width and 2.6" in height. Positioned on top of refractory bricks 36, and aligned in two rows in staggered form, are silicon carbide plates for supporting product to be fired, each measuring 21.3" in length, 10.6" in width and 1.2" in thickness. The remaining space within the perimeter of the refractory blocks 32, 27 is filled with a low-density, low heat capacity, insulating material 14, such as Fiber-Frax, an alumina fiber, to complete the lower, load-bearing base. From the top surface of the lower load-bearing base to the top of the track, is 17.7", a difference of approximately 15.8" in height from that of the commercially-available stringer-girder kiln car. As a result of the difference in height, the lower load-bearing surface lies in a plane below the bench of the kiln of about 4–5", thereby providing an increased cross-sectional area for product firing, which permits the use of an upper load-bearing base to accommodate an increased number of product to be fired, without requiring additional energy. The second tier or upper load-bearing base measures 82.6" in length, 51.6" in width and is 40.2" from the track. The upper base is supported by tubular columns 34. As illustrated in FIG. 5, by providing a second load-bearing base, an additional quantity of product can be fired, increasing the number of pieces fired from 19 to 26 pieces of product, having an average total weight of 842 lbs. and the total weight of refractories being 1,698 lbs., a ratio of 2.02 of refractories to each pound of china is obtained: a reduction of refractories to china of more than one-half that of the commercially-available, stringer-girder kiln car.

The low-mass kiln car of the present invention has a reduced weight of refractories of 2,046 lbs. compared to that of the stringer-girder kiln car. The kiln car of the present invention is capable of firing 26 pieces of china and provides an increase in average weight of product fired per car per day of 402.6 lbs. as compared with 19 pieces in the conventional stringer-girder kiln car. The cycle of use per day of the kiln car of the present invention is increased due to the reduction in total weight per car, because less time is required to heat and cool the kiln car. The kiln speed of cars per day passing through the kiln is increased from 68 cars of the stringer-girder type to 87 cars of the present invention with an attendant increase of more than 31,000 lbs. of product fired. All of these improvements increase the efficiency of the use of each kiln car and of the kiln. Also, the firing of an increased number of chinaware reduces fuel consumption per piece of chinaware fired from 4,616 K cal./kg. of chinaware to 1,800 K cal./kg. of chinaware a 61% decrease in energy consumption per day.

What is claimed:

1. A kiln car having a carriage assembly including wheels for transporting the kiln car and product to be fired through a high temperature kiln, said kiln having a bench therein; a dense refractory superstructure of low mass mounted on said carriage assembly, said superstructure comprising:

a load-bearing base of dense refractory of low mass and low heat capacity, having product-supporting means to provide a load-bearing surface, the plane of which is adapted to lie below the plane of the bench of said kiln, to provide an increased cross-sectional area for product firing;

said low-mass, load-bearing base having means for supporting an upper load-bearing base;

a layer of insulating refractory forming a thermal barrier mounted on the upper surface of said carriage assembly, on which said load-bearing base is mounted;

said load-bearing base including a plurality of low-mass, dense, refractory blocks mounted on said insulating refractory and forming a perimeter on said insulating refractory; and a low density, low heat capacity, thermal-insulating material is positioned interiorly of said perimeter of refractory blocks, filling the spaces between said refractory blocks and said product-supporting means to form load-bearing base of low mass and low heat capacity.

2. The kiln car of claim 1, wherein said product supporting means is a dense, refractory plate supported on dense, refractory bricks, mounted on said insulating refractory and positioned interiorly of said perimeter of said lower base.

3. The kiln car as set forth in claim 1, wherein said plurality of dense refractory blocks include spacer blocks of dense refractory and refractory blocks having a socket therein for mounting said supporting means.

4. The kiln car as set forth in claim 2, wherein said supporting means is a tubular dense refractory.

5. The kiln car as set forth in claim 3, wherein said tubular dense refractory material is silicon carbide.

6. The kiln car of claim 1, wherein said low density, low heat capacity, thermal-insulating material is in the form of an alumina fiber.

7. The kiln car of claim 1, wherein said perimeter of refractory blocks include an outwardly-extending horizontal flange, forming a longitudinally-extending rail to provide a damper to prevent heat from circulating around said carriage assembly.

8. A kiln car having a carriage assembly including wheels for transporting the kiln car and product to be fired through a high temperature kiln, said kiln having a bench therein; a dense refractory superstructure of low mass mounted on said carriage assembly, said superstructure comprising:

a lower load-bearing base of low mass and low heat capacity having a product-supporting means to provide a load bearing surface, the plane of which is adapted to lie below the plane of the bench of the kiln, to provide an increased cross-sectional area for product firing, while also having reduced thermal conductivity so that heat damage to the carriage assembly, including the wheels and bearings, is obviated;

an upper load bearing base having support means mounted on said lower load bearing base;

said lower load-bearing base including a plurality of low mass, dense refractory blocks and a plurality of spacer blocks of dense refractory, arranged and constructed to form a perimeter of refractory blocks having a horizontal flange extending longitudinally of the carriage assembly, to provide a damper to prevent heat from circulating therearound; said dense refractory blocks having a socket formed therein;

a low density, low heat capacity, thermal-insulating material positioned interiorly of said perimeter of said refractory blocks, and filling the spaces between the refractory blocks and said product-supporting means to form a lower load-bearing base of low mass and low heat capacity;

said upper base supporting means including a plurality of tubular columns of dense refractory mounted in said sockets and supporting said upper load-bearing base of low mass.

* * * * *